US008942604B2

(12) United States Patent
Ogiyama

(10) Patent No.: US 8,942,604 B2
(45) Date of Patent: Jan. 27, 2015

(54) IMAGE FORMING APPARATUS

(75) Inventor: Hiromi Ogiyama, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 181 days.

(21) Appl. No.: 13/472,897

(22) Filed: May 16, 2012

(65) Prior Publication Data

US 2012/0321336 A1 Dec. 20, 2012

(30) Foreign Application Priority Data

Jun. 16, 2011 (JP) ..... 2011-134078

(51) Int. Cl.
*G03G 15/01* (2006.01)
*G03G 15/16* (2006.01)

(52) U.S. Cl.
CPC ..... *G03G 15/1675* (2013.01); *G03G 15/0189* (2013.01); *G03G 15/1605* (2013.01); *G03G 2215/0129* (2013.01)
USPC ..... 399/302

(58) Field of Classification Search
USPC ..... 399/302, 308
See application file for complete search history.

(56) References Cited

U.S. PATENT DOCUMENTS

| | | | | |
|---|---|---|---|---|
| 4,528,937 | A | 7/1985 | Kanno et al. | |
| 4,851,874 | A | 7/1989 | Ogiyama | |
| 5,483,330 | A | 1/1996 | Ogiyama et al. | |
| 6,405,002 | B2 | 6/2002 | Ogiyama et al. | |
| 6,618,565 | B2 | 9/2003 | Sawai et al. | |
| 6,697,595 | B2 | 2/2004 | Kawagoe et al. | |
| 6,741,821 | B2 | 5/2004 | Sugino et al. | |
| 6,785,500 | B2 | 8/2004 | Takahashi et al. | |
| 6,829,450 | B2 | 12/2004 | Tamiya et al. | |
| 6,901,234 | B2 | 5/2005 | Ogiyama et al. | |
| 7,003,238 | B2 | 2/2006 | Yoshida et al. | |
| 7,203,433 | B2 | 4/2007 | Kato et al. | |
| 7,280,792 | B2 | 10/2007 | Sawai et al. | |
| 7,346,287 | B2 | 3/2008 | Ogiyama et al. | |
| 7,610,004 | B2 | 10/2009 | Kato et al. | |
| 7,773,928 | B2 | 8/2010 | Ogiyama et al. | |
| 8,238,773 | B2 * | 8/2012 | Usami et al. | 399/66 |
| 8,326,195 | B2 * | 12/2012 | Aimoto et al. | 399/314 |

(Continued)

FOREIGN PATENT DOCUMENTS

| | | |
|---|---|---|
| JP | 11-24443 | 1/1999 |
| JP | 2000-19854 | 1/2000 |
| JP | 2002-244528 | 8/2002 |
| JP | 2004-126430 | 4/2004 |
| JP | 2004-184874 | 7/2004 |

(Continued)

*Primary Examiner* — Gregory H Curran
(74) *Attorney, Agent, or Firm* — Oblon, Spivak, McClelland, Maier & Neustadt, L.L.P.

(57) ABSTRACT

An image forming apparatus includes a primary transfer device to transfer a toner image formed on a photosensitive member onto an intermediate transfer member formed into a loop, a secondary transfer device disposed outside the looped belt to contact the intermediate transfer member to form a secondary transfer nip therebetween and transfer the toner image from the intermediate transfer member onto a recording medium, a first power supply to apply a constant-current controlled direct current bias to an inner circumferential side of the intermediate transfer member, and a second power supply to form an alternating electric field between the intermediate transfer member and the recording medium. The direct current bias has the same polarity as that of the toner image. The first power supply and the second power supply apply predetermined biases simultaneously when the recording medium is in the secondary transfer nip to transfer the toner image thereon.

15 Claims, 7 Drawing Sheets

(56) References Cited

U.S. PATENT DOCUMENTS

| | | | |
|---|---|---|---|
| 2003/0118359 | A1 | 6/2003 | Ogiyama et al. |
| 2008/0232867 | A1 | 9/2008 | Minbu et al. |
| 2010/0080631 | A1 | 4/2010 | Ogiyama et al. |
| 2010/0098446 | A1 | 4/2010 | Ishikawa et al. |

FOREIGN PATENT DOCUMENTS

| | | |
|---|---|---|
| JP | 2006-267486 | 10/2006 |
| JP | 2006-330110 | 12/2006 |
| JP | 2007-328317 | 12/2007 |
| JP | 2011-7907 | 1/2011 |

* cited by examiner

IMAGE FORMING APPARATUS

CROSS-REFERENCE TO RELATED APPLICATION

This patent application is based on and claims priority pursuant to 35 U.S.C. §119 to Japanese Patent Application No. 2011-134078, filed on Jun. 16, 2011 in the Japanese Patent Office, the entire disclosure of which is hereby incorporated by reference herein.

BACKGROUND OF THE INVENTION

1. Field of the Invention

Exemplary aspects of the present disclosure generally relate to an image forming apparatus, such as a copier, a facsimile machine, a printer, or a multi-functional system including a combination thereof, and more particularly to, an intermediate transfer device and an image forming apparatus using the intermediate transfer device.

2. Description of the Related Art

Related-art image forming apparatuses, such as copiers, facsimile machines, printers, or multifunction printers having at least one of copying, printing, scanning, and facsimile capabilities, typically form an image on a recording medium according to image data. Thus, for example, a charger uniformly charges a surface of an image bearing member (which may, for example, be a photosensitive drum); an optical writer projects a light beam onto the charged surface of the image bearing member to form an electrostatic latent image on the image bearing member according to the image data; a developing device supplies toner to the electrostatic latent image formed on the image bearing member to render the electrostatic latent image visible as a toner image; the toner image is directly transferred from the image bearing member onto a recording medium or is indirectly transferred from the image bearing member onto a recording medium via an intermediate transfer member in a process known as intermediate transfer; a cleaning device then cleans the surface of the image carrier after the toner image is transferred from the image carrier onto the recording medium; finally, a fixing device applies heat and pressure to the recording medium bearing the unfixed toner image to fix the unfixed toner image on the recording medium, thus forming the image on the recording medium.

Generally, in known color-image forming apparatuses, four image bearing members (which may, for example, be photosensitive drums), one for each of the colors black, yellow, magenta, and cyan, are arranged in tandem facing a belt-type intermediate transfer member (hereinafter referred to as simply "intermediate transfer belt"), and multiple toner images of a respective single color are formed on the image bearing members. Then, the toner images are transferred onto the intermediate transfer belt so that they are superimposed one atop the other, thereby forming a composite toner image on the intermediate transfer belt. This process is known as a "primary transfer process".

In an image forming apparatus using the intermediate transfer process, the composite toner image on the intermediate transfer belt is transferred onto a recording medium such as a sheet of paper at a secondary transfer nip at which the intermediate transfer belt contacts a secondary transfer member (which may, for example, be a secondary transfer roller) in a process known as a "secondary transfer process". The intermediate transfer belt is formed into a loop and entrained around a plurality of rollers, one of which faces and presses against the secondary transfer member via the intermediate transfer belt, thereby forming the secondary transfer nip. This roller is known as a secondary transfer counter roller.

In such an image forming apparatus in which an image is formed on the recording medium through the first and the secondary transfer processes, transferability is decreased due to environmental changes. In view of the above, various approaches have been proposed in an attempt to solve the problem.

For example, in one approach, the secondary transfer roller is grounded, and a certain amount of electrical current having the same polarity as that of the toner is supplied to the secondary transfer counter roller disposed inside the loop formed by the intermediate transfer belt. In this configuration, even when an electrical resistance of the devices such as the intermediate transfer belt, the secondary transfer counter roller, and the secondary transfer roller fluctuates, degradation of the transferability in the secondary transfer process is prevented.

Although effective, there is a drawback to the above-described approach. That is, when the toner image on the intermediate transfer belt bears a large amount toner, when an amount of electric charge or non-electrostatic adhesion of toner of the toner image is large, and/or a recording medium has a high volume resistance and includes insulation properties such as an OHP sheet or the like, a secondary transfer voltage for supplying a certain amount of secondary transfer current to the secondary transfer counter roller becomes large. The large secondary transfer voltage requires a high-voltage power supply capable of supplying a high voltage and a high-voltage wiring harness with a high withstand voltage, which are generally expensive. Furthermore, an insulating member with a high withstand voltage, which is also generally expensive, needs to be provided around an electrode connected to the secondary transfer counter roller, and a large creepage distance and clearance are required relative to the secondary transfer counter roller.

Moreover, with recording media having different surface characteristics, it is difficult to optimally transfer the toner image onto the recording medium under the same transfer conditions. Accordingly, in order to optimally transfer the toner image onto a recording medium having surface characteristics different from the preceding recording medium, for example, a bias of the same polarity as the toner is applied to the secondary transfer counter roller with a constant current or a constant voltage while applying a bias of the opposite polarity to the polarity of toner with a constant current or a constant voltage, to the secondary transfer roller. In this configuration, application of the bias to the secondary transfer counter roller and application of the bias to the secondary transfer roller are performed selectively in accordance with transfer conditions, and the applied voltages are relatively high. Such high-voltage power supplies capable of supplying a high voltage are relatively large and expensive, thus hindering efforts to provide the low-cost, compact image forming apparatuses for which there is market demand.

In order to enhance transferability when forming an image on a recording medium having a coarse surface such as an embossed sheet, the surface of the recording medium on which the toner image is transferred is charged to the opposite polarity to the polarity of the toner prior to the transfer process. In this configuration, upon transfer of the toner image, a transfer bias consisting of an alternating current (AC) voltage superimposed on a direct current (DC) voltage is supplied to the secondary transfer roller, and the rear surface of the intermediate transfer belt is grounded. Although effective, the transferability of secondary transfer is still degraded when the electrical resistance of the devices and/or the recording medium fluctuates due to environmental changes.

In order to prevent degradation of transferability in the secondary transfer process in a high-speed image forming apparatus when environmental changes cause the electrical resistance of the devices and the recording medium to fluctuate, a bias of the same polarity as the toner can be applied to the intermediate transfer belt by the secondary transfer counter roller during the secondary transfer process to keep the electrical current constant while applying a bias having the opposite polarity to the polarity of the toner to the secondary transfer roller to keep the voltage constant.

In this configuration, a direct-current power supply is employed. When using a recording medium having a coarse surface such as the embossed sheet, a transfer potential of recessed portions of the recording medium is lower than that of projecting portions, so that the toner is not transferred adequately to the recessed portion, thereby yielding a resulting image with white spots.

In view of the above, there is thus an unsolved need for an image forming apparatus capable of maintaining good transferability regardless of fluctuation of the electrical resistance of devices as well as surface conditions of recording media.

BRIEF SUMMARY

In view of the foregoing, in an aspect of this disclosure, there is provided an improved image forming apparatus including a photosensitive member, a developing device, an intermediate transfer member, a primary transfer device, a secondary transfer device, a first power supply, and a second power supply. The photosensitive member bears an electrostatic latent image on a surface thereof. The developing device develops the electrostatic latent image formed on the photosensitive member using toner to form a toner image. The intermediate transfer member bears the toner image on the surface thereof. The intermediate transfer member is disposed opposite the photosensitive member and formed into a loop. The primary transfer device transfers the toner image from the photosensitive member onto the intermediate transfer member. The secondary transfer device transfers the toner image from the intermediate transfer member onto a recording medium. The secondary transfer device is disposed outside the loop formed by the intermediate transfer member to contact the intermediate transfer member and form a secondary transfer nip therebetween. The first power supply applies a constant-current controlled direct current bias to an inner circumferential side of the intermediate transfer member. The direct current bias has the same polarity as that of the toner image. The second power supply forms an alternating electric field between the intermediate transfer member and the recording medium. The first power supply and the second power supply apply predetermined biases simultaneously when the recording medium is in the secondary transfer nip to transfer the toner image thereon.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF DISCLOSED EMBODIMENTS

Figure 1:
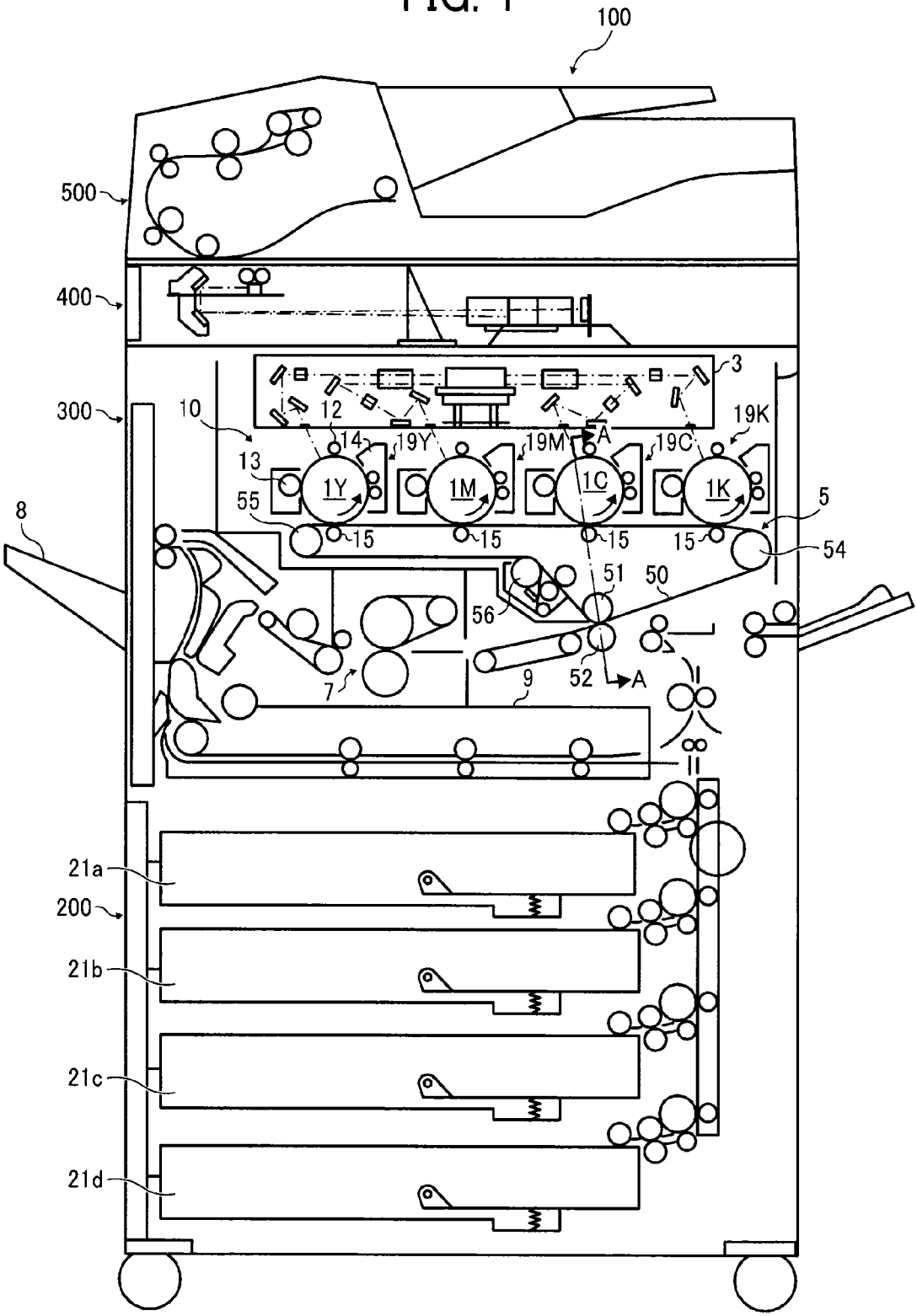
FIG. 1 is a schematic diagram illustrating an image forming apparatus according to an illustrative embodiment of the present invention.

A description is now given of illustrative embodiments of the present application. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof paper feeder, etc., it should be understood that the sheets, etc., are not limited only to paper, but includes other printable media as well.

Referring now to the drawings, wherein like reference numerals designate identical or corresponding parts throughout the several views, and initially with reference to FIG. 1, a description is provided of an image forming apparatus according to an aspect of this disclosure.

FIG. 1 is a schematic diagram illustrating a color printer as an example of the image forming apparatus. In FIG. 1, an image forming apparatus 100 includes a printer main body 300, a sheet feeding unit 200, an image reader 400 such as a scanner, and an automatic document feeder 500 (hereinafter referred to as simply "ADF"). The printer main body 300 is disposed substantially in the center of the image forming apparatus 100. The sheet feeding unit 200 is disposed below the printer main body 300. The image reader 400 is disposed above the printer main body 300. The ADF 500 is disposed above the image reader 400. The image forming apparatus 100 is a tandem-type image forming apparatus in which four sets of image forming stations 19Y, 19M, 19C, and 19K are arranged in tandem in an image forming unit 10 of the printer main body 300.

In the printer main body 300, an intermediate transfer unit 5 serving as a transfer mechanism is disposed below the image forming unit 10. The intermediate transfer unit 5 includes an intermediate transfer belt 50 serving as an intermediate transfer member onto which toner images produced in the image forming stations 19Y through 19K are transferred. The image forming stations 19Y, 19M, 19C, and 19K are arranged in tandem along the intermediate transfer belt 50 in the direction of movement of the intermediate transfer belt 50. It is to be noted that the suffixes Y, M, C, and K denote colors yellow, magenta, cyan, and black, respectively. To simplify the description, the suffixes Y, M, C, and K indicating colors are omitted herein, unless otherwise specified.

The image forming stations 19Y, 19M, 19C, and 19K include photosensitive drums 1Y, 1M, 1C, and 1K, respectively. A document fed to the ADF 500 is sent to the image reader 400. The printer main body 300 includes an exposure device 3 to illuminate surfaces of the photosensitive drums 1Y, 1M, 1C, and 1K with a light beam based on image information of a document read by the image reader 400 or provided by an external device such as a personal computer (PC), thereby forming latent images on the respective photosensitive drums 1Y, 1M, 1C, and 1K. The image forming stations 19Y, 19M, 19C, and 19K all have the same configuration as all the others, differing only in the color of toner employed. Thus, for simplicity, in FIG. 1, constituent parts are shown only for the image forming station 19Y, and the suffix Y indicating the color yellow is omitted. Each of the photosensitive drums 1Y, 1M, 1C, and 1K is surrounded by various pieces of imaging equipment, such as a developing device 13, a drum cleaner 14, and a primary transfer roller 15.

The photosensitive drums 1Y, 1M, 1C, and 1K are rotated in a direction indicated by an arrow in FIG. 1 by a driving device (not illustrated). It is to be noted that the photosensitive drum 1K for the color black is rotated independently from other photosensitive drums 1Y, 1M, and 1C for color printing. In this configuration, when forming a monochrome image, only the photosensitive drum 1K for the color black is rotated; whereas, when forming a color image, all four photosensitive drums 1Y, 1M, 1C, and 1K are driven at the same time.

The intermediate transfer belt 50 is formed into a loop and entrained around a plurality of rollers: a secondary transfer counter roller 51, and support rollers 54 and 55. One of the rollers, normally, the support roller 54, is rotated by a driving motor, enabling the intermediate transfer belt 50 to move in the clockwise direction endlessly. A roller 56 in FIG. 1 is a tension roller that contacts an outer circumferential surface of the intermediate transfer belt 50.

Primary transfer rollers 15 are disposed opposite the photosensitive drums 1Y, 1M, 1C, and 1K with the intermediate transfer belt 50 interposed therebetween, thereby forming primary transfer nips at which toner images are transferred from the photosensitive drums 1Y, 1M, 1C, and 1K onto the intermediate transfer belt 50. According to an illustrative embodiment, the primary transfer rollers 15 include a moving device that separates the primary transfer rollers 15 for the colors yellow, magenta, and cyan from the photosensitive drums 1Y, 1M, and 1C when a monochrome image is formed. When image forming operation is not performed, the moving device separates the primary transfer rollers 15 for all colors from the photosensitive drums 1Y, 1M, 1C, and 1K.

The intermediate transfer belt 50 serving as a transfer medium is pressed against the photosensitive drums 1Y, 1M, 1C, and 1K by the primary transfer rollers 15, forming the primary transfer nips therebetween.

A secondary transfer roller 52 is disposed opposite the secondary transfer counter roller 51 with the intermediate transfer belt 50 interposed therebetween, forming a so-called secondary transfer nip. The secondary transfer roller 52 contacts the intermediate transfer belt 50 at a certain pressure to transfer the toner image formed on the intermediate transfer belt 50 to a recording medium.

When forming a color image in the image forming apparatus 100, each of the photosensitive drums 1Y, 1M, 1C, and 1K are rotated in the direction indicated by the arrow in FIG. 1, and the surfaces of the photosensitive drums 1Y, 1M, 1C, and 1K are charged to a certain polarity, for example, a negative polarity, by the charging devices 12. Subsequently, the charged surfaces of the photosensitive drums 1Y, 1M, 1C, and 1K are illuminated with modulated light beams projected from the exposure device 3. Accordingly, electrostatic latent images are formed on the surfaces of the photosensitive drums 1Y, 1M, 1C, and 1K. More specifically, when the surfaces of the photosensitive drums 1Y, 1M, 1C, and 1K are illuminated with the light beams, the place where absolute values of the potential drops appears as an electrostatic latent image (an image portion), and the place where the light beams do not illuminate so that the absolute values of the potential remain high becomes a background portion where no image is formed.

Subsequently, the electrostatic latent images formed on the photosensitive drums 1Y, 1M, 1C, and 1K are developed with charged toner stored in the developing devices 13. Accordingly, the electrostatic latent images on the photosensitive drums 1 are developed into visible images, known as toner images.

The toner images formed on the photosensitive drums 1Y, 1M, 1C, and 1K are transferred onto the intermediate transfer belt 50 at the primary transfer nips due to pressure and a transfer electric field so that the toner images are superimposed one atop the other, thereby forming a composite color toner image on the surface of the intermediate transfer belt 50.

Residual toner, not having been transferred, thus remaining on the photosensitive drums 1Y, 1M, 1C, and 1K, is removed by a drum cleaner 14. The removed toner can be recycled by transporting the removed toner to the developing devices 13 using a toner recycling mechanism, not illustrated.

In terms of a recording medium, the sheet feeding unit 200 includes multiple sheet cassettes 21*a*, 21*b*, 21*c*, and 21*d* that store recording media sheets. The recording medium is sent to the secondary transfer nip between the secondary counter roller 51 and the secondary transfer roller 52 from one of the sheet cassettes 21*a*, 21*b*, 21*c*, and 21*d* in predetermined timing. The composite color toner image on the intermediate transfer belt 50 is transferred onto the recording medium at the secondary transfer nip.

After the secondary transfer, the recording medium, onto which the composite color toner image is transferred, is transported to a fixing device 7 in which heat and pressure are applied to the recording medium, thereby fixing the composite toner image on the recording medium. After the image is fixed on the recording medium, the recording medium is discharged onto a sheet discharge tray 8, or transported to a sheet reverse unit 9 in which the recording medium is turned over so that an image is formed on the other side of the recording medium. The residual toner remaining on the intermediate transfer belt 50 is removed by a belt cleaning device.

Figure 2:
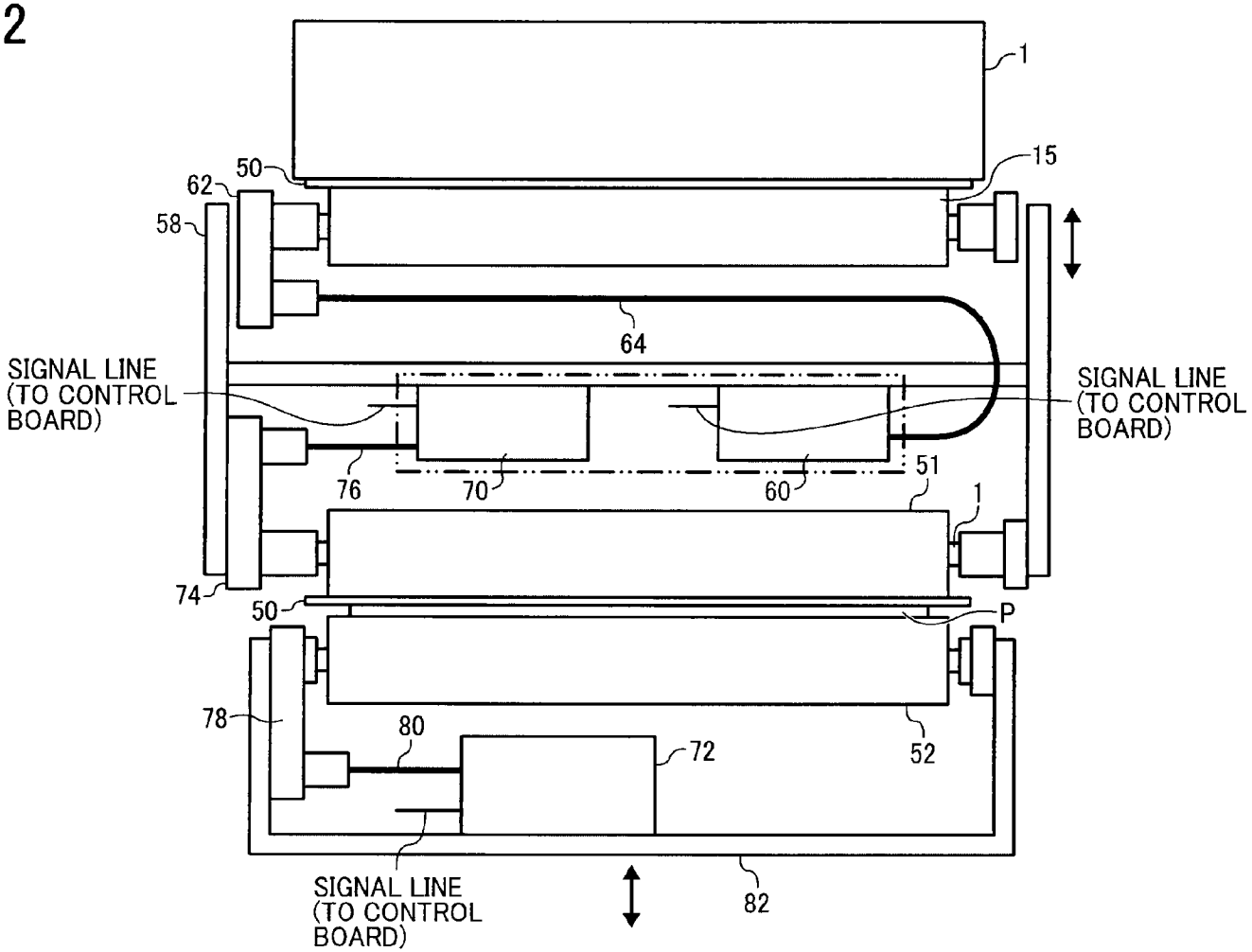
FIG. 2 is a cross-sectional view of a printer main body of the image forming apparatus of FIG. 1 along a line A-A in FIG. 1 according to a first illustrative embodiment of the present invention.

With reference to FIG. 2, a description is provided of an example of application of voltage to the primary transfer nip and the secondary transfer nip. FIG. 2 is a cross-sectional view of the printer main body 300 along a line A-A in FIG. 1. FIG. 2 shows a state in which a recording medium P is interposed between the secondary transfer roller 52 and the secondary transfer counter roller 51, and an image is transferred from the intermediate transfer belt 50 to the recording medium P.

The intermediate transfer belt 50, the primary transfer rollers 15 disposed inside the looped intermediate transfer belt 50, the secondary transfer counter roller 51, a primary power supply for primary charging, a secondary power supply for secondary charging, the belt cleaner, and so forth constitute an intermediate transfer unit. The intermediate transfer unit is disposed in a housing 58 and detachably attachable relative to the printer main body 300. As described above, the primary transfer rollers 15 contact and separate from the photosensitive drums 1 by the moving device in the primary transfer unit in the housing 58.

A high voltage direct current (DC) power supply 60 serving as the primary power supply is a constant current power supply that supplies a bias voltage having an opposite polarity to the polarity of toner. One high voltage DC power supply 60 is provided for each color. The primary transfer roller 15 is supported by a holder 62. Inside the holder 62, a high voltage connector having a connecting terminal that contacts an end surface of a shaft (metal core) of the primary transfer roller 15 is disposed at one side of the holder 62. The high voltage connector is electrically connected to the high voltage DC power supply 60 via a high voltage harness 64.

According to an illustrative embodiment, as illustrated in FIG. 2, the secondary power supply for secondary charging is comprised of a high voltage direct current (DC) power supply 70 (constant current control) serving as a first power supply and a high voltage alternating current (AC) power supply 72 (constant voltage control) serving as a second power supply. The high voltage DC power supply 70 supplies a bias voltage having the same polarity of toner (here, a negative polarity) to the secondary transfer counter roller 51. The high voltage AC power supply 72 applies a bias to the secondary transfer roller 52.

The high voltage DC power supply 70 and the high voltage DC power supply 60 are disposed on the same board 90. The board 90 is disposed inside loop formed by the intermediate transfer belt 50 (in a space at the upper portion of the secondary transfer counter roller 51). By contrast, the high voltage AC power supply 72 is disposed outside the loop formed by the intermediate transfer belt 50. The high voltage DC power supply 70 is disposed inside the loop formed by the intermediate transfer belt 50 near the secondary transfer counter roller 51 so that the space inside the loop is effectively used, and a high voltage wire connecting the high voltage power supply and the secondary transfer counter roller 51 can be short, thereby reducing the number of connectors.

The high voltage AC power supply 72 is disposed outside the loop formed by the intermediate transfer belt 50 near the secondary transfer roller 52 so that a high voltage wire connecting the AC power supply and the intermediate transfer belt 50 can be short. As illustrated in FIG. 2, the high voltage AC power supply 72 is placed at a distance from the high voltage DC power supplies 60 and 70 via the secondary transfer roller 52 and secondary transfer counter roller 51. With this configuration, the alternating current of the high voltage AC power supply 72 does not interfere with the high voltage wires and signal lines of the high voltage DC power supplies 60 and 70. That is, interference of the high voltage wires and noise on the signal lines are suppressed.

The secondary transfer counter roller 51 is supported by a holder 74 attached to the housing 58. Inside the holder 74, a high voltage connector having a connecting terminal that contacts an end surface of a shaft (metal core) of the secondary transfer counter roller 51 is disposed at one side of the holder 74. The high voltage connector is electrically connected to the high voltage DC power supply 70 via a high voltage harness 76.

Similarly, the secondary transfer roller 52 is supported by a holder 78 attached to a housing 82 which houses the secondary transfer roller 52. Inside the holder 78, a high voltage connector having a connecting terminal that contacts an end surface of a shaft (metal core) of the secondary transfer roller 52 is disposed at one side of the holder 78. The high voltage connector is electrically connected to the high voltage AC power supply 72 via a high voltage harness 80. The high voltage DC power supply 60 for primary charging, the high voltage DC power supply 70 for secondary charging, and the high voltage AC power supply 72 are connected to a control board disposed in the printer main body 300 via the signal lines.

It is to be noted that, although not illustrated, the housing 82 houses a cleaning device, a lubricant applicator, a brush to remove paper dust, and so forth for the secondary transfer roller 52. A secondary transfer unit including the secondary transfer roller 52 is movable by a moving device so that the secondary transfer unit can contact and separate from the secondary transfer counter roller 51. Furthermore, the secondary transfer unit is detachably attachable relative to the intermediate transfer unit and the printer main body 300.

The intermediate transfer belt 50 has a single layer made of mainly polyimide resin with a thickness of approximately 80 μm and a width of approximately 320 mm. The material is not limited to polyimide resin, but may include vinylidene fluoride and ethylene tetrafluoroethylene copolymer. Alternatively, the intermediate transfer belt 50 may be multilayered including a release layer provided on top of the belt surface. The intermediate transfer belt 50 is driven at a process speed of approximately 282 mm/second.

A surface resistivity of the rear surface of the intermediate transfer belt 50 under the temperature of 23° C. and humidity of 50% is in a range of from approximately 9.5 log Ω/□ to 11.5 log Ω/□ ($10^{9.5}$~$10^{11.5}$ log Ω/□). The surface resistivity is measured by connecting an HR Probe to a high resistivity meter, Hiresta IP, (manufactured by Mitsubishi Chemical, Ltd.). The surface resistivity is calculated after 10 seconds elapses when a voltage of 500V is supplied to the intermediate transfer belt 50. A volume resistivity of the intermediate transfer belt 50 is in a range of from approximately 8 log Ω·cm to 10 log Ω·cm ($10^8$ to $10^{10}$Ω·cm).

Each of the primary transfer rollers 15 includes a metal core with a diameter of 8 mm and a resistance layer which is elastic. The resistance layer is made of copolymer of nitrile rubber (NBR) and epichlorohydrin (ECO). The outer diameter thereof is approximately 18 mm, and the length is 302 mm. The resistance of the primary transfer roller 15 under the temperature of 23° C. and humidity of 50% is in a range of from approximately 7.25 log Ω to 8.25 log Ω. The bias having the opposite polarity of the polarity of the toner is applied to the metal core of the primary transfer roller 15 using the high voltage DC power supply 60. More specifically, during color printing, a constant current in a range of from approximately +20 μA to +35 μA flows through the primary transfer roller 15.

The secondary transfer counter roller 51 serving as a repulsive force roller includes the metal core with a diameter of approximately 16 mm and a resistance layer which is elastic. The resistance layer is made of copolymer of NBR and ECO. The outer diameter of the secondary transfer counter roller 51 is approximately 24 mm, and the length thereof is approximately 302 mm. The resistance of the secondary transfer counter roller 51 under the temperature of 23° C. and humidity of 50% is in a range of from approximately 7.25 log Ω to 8.25 log Ω. As described above, the bias of the same polarity as the toner is applied to the metal core of the secondary transfer counter roller 51 using the high voltage DC power supply 70. More specifically, during color printing, a constant current in a range of from approximately −30 μA to −50 μA flows through the secondary transfer counter roller 51.

The secondary transfer roller 52 includes the metal core with a diameter of approximately 16 mm and a resistance layer which is elastic. The resistance layer is made of copolymer of NBR and ECO. The outer diameter thereof is approximately 24 mm, and the length is approximately 312 mm. The resistance of the secondary transfer roller 52 under the temperature of 23° C. and humidity of 50% is less than or equal to approximately 7.25 log Ω.

As described above, the bias is applied to the metal core of the secondary transfer roller 52 by the high voltage AC power supply 72 (sine wave). More specifically, when forming an image on an embossed sheet, a constant voltage in a range of from 6 kV to 10 kV (P to P) at 500 to 1 kHz is supplied. This setting is obtained based on an evaluation performed by a present inventor in which an image was formed on an embossed sheet using an alternating current power supply that supplied an alternating current voltage in a range of from approximately 4 to 12 kV and the image density on the embossed sheet was evaluated visually. This is because recessed portions on the embossed sheet were too small to directly measure the transferability of the secondary transfer.

According to the evaluation, it is known that as the recessed portion becomes large, an optimum alternating current voltage tends to increase, and the level of visual evaluation does not improve. If the alternating current voltage is too large, minute electrical discharge is induced, causing toner to scatter, and the density level which has been once increased drops again. Furthermore, as the resistance of the device side increases and the ambient condition becomes a low-temperature, low-humidity environment, the optimum alternating current voltage becomes large.

In the evaluation, the resistance values of the primary transfer rollers 15, the secondary transfer counter roller 51, and the secondary transfer roller 52 were measured by placing the rollers on a flat metal plate which was grounded and supplying a voltage of 1 kV to the metal cores of the rollers by a high voltage power supply for the evaluation. The current that flowed through the metal plate was measured, and the obtained value was substituted in Ohm's law.

Figure 3:
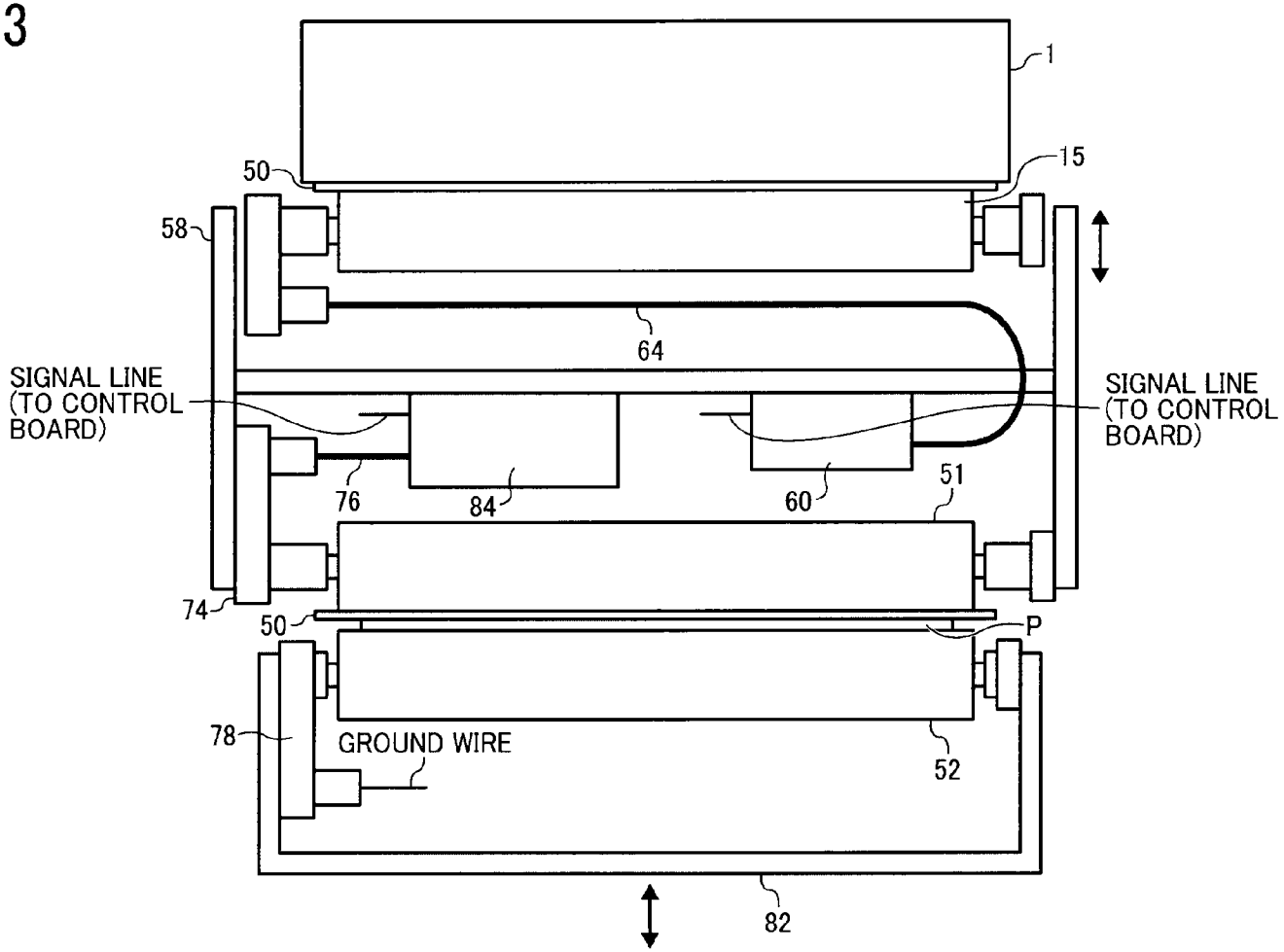
FIG. 3 is a cross-sectional view of the printer main body of the image forming apparatus of FIG. 1 along a line A-A in FIG. 1 according to a second illustrative embodiment of the present invention.

With reference to FIG. 3, a description is provided of another example of application of voltage to the primary transfer nip and the secondary transfer nip. FIG. 3 is a cross-sectional view of the printer main body 300 of the image forming apparatus of FIG. 1 along a line A-A in FIG. 1 according to a second illustrative embodiment. The difference between the configuration shown in FIG. 2 and that of shown in FIG. 3 relates to application of the secondary charging bias. Thus, the same reference numerals used in the first illustrative embodiment will be given to constituent elements such as parts and materials having the same functions, and the descriptions thereof will be omitted.

According to the present illustrative embodiment, a high voltage power supply 84 serves as a power supply for secondary charging that applies a bias to the secondary transfer counter roller 51. More specifically, an electric current consisting of a constant-voltage alternating current (sine wave) superimposed on a constant-current direct current having the same polarity as that of the toner is supplied to the secondary transfer counter roller 51. The high voltage power supply 84 is connected electrically to an end surface of the metal core of the shaft of the secondary transfer counter roller 51 via the high voltage harness 76 and the high voltage connector provided inside the holder 74 at one end of the holder 74 that supports the secondary transfer counter roller 51. The metal core of the secondary transfer roller 52 is grounded.

In order to prevent instability of the direct current for the primary transfer due to the alternating current component of the high voltage power supply 84, a shield made of metal may be provided between the high voltage power supply 60 and the high voltage power supply 84 to block an alternating electric field. Alternatively, the high voltage power supply 60 may be spaced apart a certain distance from the high voltage power source 84 within the loop formed by the intermediate transfer belt 50. However, the shield is preferable, because there is a spatial limitation inside the looped intermediate transfer belt 50. As described above, when forming a monochrome image, the primary transfer rollers 15 except the primary transfer roller for black separate from the photosensitive drums 1. Thus, the space inside the looped belt is limited, and hence the shield is preferable.

According to the illustrative embodiment of FIG. 2, the voltage having the same polarity as that of the toner is supplied to the secondary transfer counter roller 51 disposed inside the loop formed by the intermediate transfer belt 50. The alternating current voltage which does not contain the direct current voltage is supplied to the secondary transfer roller 52 disposed outside the looped intermediate transfer belt 50. The high voltage DC power supply 70 that applies a bias to the secondary transfer counter roller 51 is disposed inside the loop of the intermediate transfer belt 50. The high voltage AC power supply 72 that applies a bias to the secondary transfer roller 52 is disposed outside the looped intermediate transfer belt 50.

In such a configuration, it is known that in order to separate the recording medium, on which an unfixed toner image has been transferred, from the intermediate transfer belt 50, a bias is applied by a charge eliminator including a charge eliminating needle disposed at the downstream side of secondary transfer nip in the direction of transport of the recording medium. In an image forming apparatus equipped with such a charge eliminator, a charge eliminating bias applied to the charge eliminating needle and an alternating current bias applied to the secondary transfer roller disposed upstream from the charge eliminator in the direction of transport of the recording medium interfere with each other such that the alternating current flows in the power supplies and electric wires of both the charge eliminator and the secondary transfer roller.

Furthermore, there is a moment in which an electric field between the charge eliminating needle and the secondary transfer roller that cyclically fluctuates significantly. As a result, leak easily occurs between the charge eliminating needle and the primary transfer roller.

Figure 4:
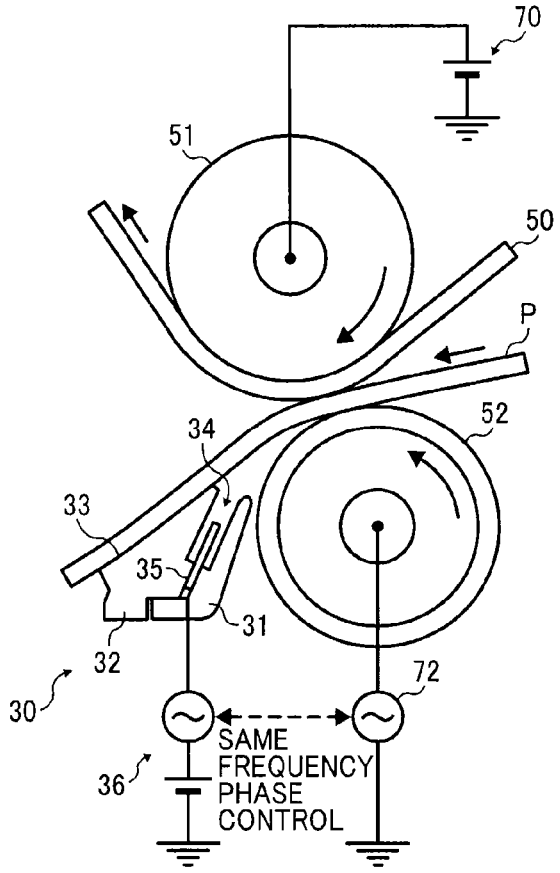
FIG. 4 is a cross-sectional schematic diagram illustrating devices at a secondary transfer nip, including a secondary transfer roller, a secondary transfer counter roller, and a charge eliminator, according to one or more embodiments of the present invention.

With reference to FIG. 4, a description is provided of a configuration that counteracts such difficulty. FIG. 4 is a cross-sectional schematic diagram illustrating a charge eliminator according to an illustrative embodiment of the present invention.

An unfixed toner image borne on the intermediate transfer belt 50 arrives at the secondary transfer nip as the intermediate transfer belt 50 rotates while the recording medium P is fed to the secondary transfer nip in appropriate timing. Accordingly, in the secondary transfer nip, the image bearing surface of the intermediate transfer belt 50 on which the unfixed toner image is transferred and the recording medium are interposed between the secondary transfer counter roller 51 and the secondary transfer roller 52.

The high voltage DC power supply 70 subjected to constant current control applies the bias of the same polarity as the toner, that is, the negative voltage, to the metal core of the secondary transfer counter roller 51. In other words, the bias is applied to the inner circumferential surface of the intermediate transfer belt 50. The high voltage AC power supply 72 subjected to a constant voltage control applies the bias to the secondary transfer roller 52, thereby forming the alternating electric field between the intermediate transfer belt 50 and the recording medium P.

As illustrated in FIG. 4, a charge eliminator 30 is disposed downstream from the secondary transfer nip in the direction of transport of the recording medium. The charge eliminator 30 includes a first support 31, a second support 32 including a guide surface 33, a charge eliminating needle 35, and a voltage applicator 36. The first support 31 and the second support 32 are constituted as a single integrated member. The guide surface 33 of the second support 32 guides the recording medium P separated from the intermediate transfer belt 50. A hole 34 is formed by the first support 31 and the second support 32. The charge eliminating needle 35 is held in the hole 34.

The voltage applicator 36 is connected to the charge eliminating needle 35 to supply voltage thereto. The voltage applicator 36 is an alternating voltage supply in which a direct current and an alternating current are superimposed. Alternatively, the voltage supply device 36 may be an alternating current power supply. As illustrated in FIG. 4, the voltage applicator 36 and the high voltage AC power supply 72 are disposed outside the loop formed by the intermediate transfer belt 50 and attached to the housing 82 of the secondary transfer unit or attached to the same board.

The charge eliminating needle 35 is formed of a stainless steel plate with a thickness of approximately 0.1 mm formed into a saw-like shape with a width of approximately 3 mm and a length of approximately 8 mm. During printing, the charge eliminating needle 35 is supplied with an alternating current component as illustrated in FIG. 5 regardless of types of the recording medium.

The frequency of the alternating current voltage or an alternating current component of the alternating voltage supplied to the charge eliminating needle 35 is similar to, if not the same as, the frequency of the alternating current voltage supplied to the secondary transfer roller 52, and a phase shift is equal to or less than a quarter cycle. More specifically, the voltage applicator 36 generates the high voltage alternating current such that a clock signal externally inputted is subjected to a clock division circuit and then the waveform is shaped. The high voltage AC power supply 72 generates the high voltage alternating current such that the externally-inputted clock signal used to generate the high voltage alternating current for the charge eliminating needle 35 is subjected to the clock division circuit and a phase adjusting circuit, and then the waveform is shaped. The voltage applicator 36 and the high voltage AC power supply 72 output alternating voltage such that the phase shift between the waveform of the high voltage alternating current from the charge eliminating needle 35 and the waveform of the high voltage alternating current from the secondary transfer roller 52 is equal to or less than a quarter cycle.

Referring now to FIGS. 5A through 5E, a description is provided of a cyclical change in a potential difference between the bias applied to the charge eliminating needle 35 and the bias applied to the metal core of the secondary transfer roller 52. In FIGS. 5A through 5E, the bias applied to the charge eliminating needle 35 is 12 kV (P-to-P), and the bias applied to the metal core of secondary transfer roller 52 is 8 kV (P-to-P).

Figure 5A:
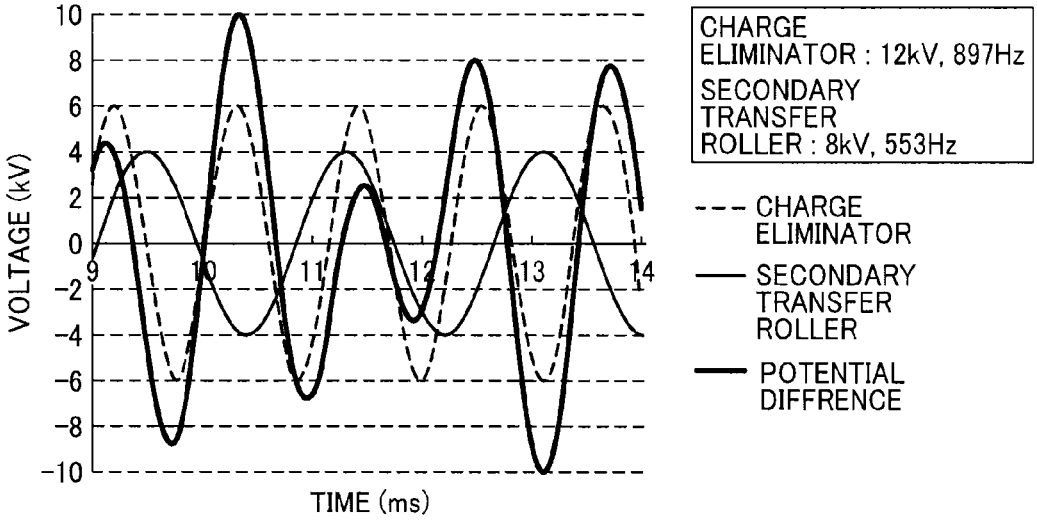
FIG. 5A is a graph showing a cyclical change in a potential difference between a bias applied to the charge eliminator and a bias applied the secondary transfer roller of FIG. 4 when frequencies of the biases are different.

FIG. 5A is a graph showing a cyclical change in the potential difference between the bias applied to the charge eliminating needle 35 and the bias applied the secondary transfer roller 52 when frequencies of the biases are different. As shown in FIG. 5A, the potential difference between the bias applied to the charge eliminating needle 35 and the bias applied to the secondary transfer roller 52 indicated by a thick solid line fluctuates substantially due to the difference between the frequency of the bias applied to the charge eliminating needle 35 and the frequency of the bias applied to the secondary transfer roller 52. However, the potential difference between these biases when the fluctuation is at its maximum is 10 kV, which is the sum of half of the peak voltages of these biases.

In FIGS. 5B through 5E, the frequencies of the biases applied to the charge eliminating needle 35 and the metal core of the secondary transfer roller 52 are the same, but the phase shift is different.

Figure 5B:
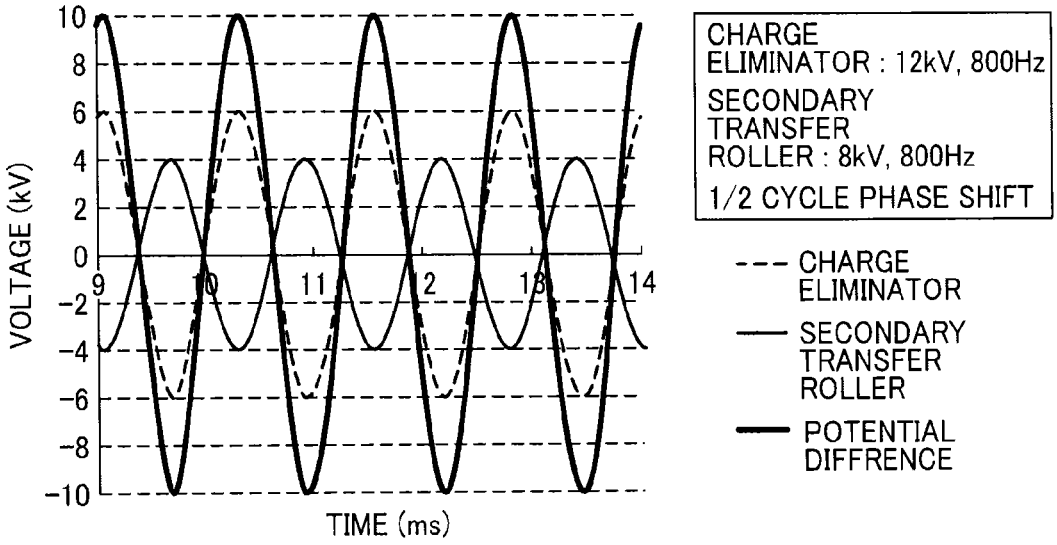
FIG. 5B is a graph showing a cyclical change in the potential difference between the bias applied to the charge eliminator and the bias applied the secondary transfer roller when the frequencies of the biases are the same but there is a half-cycle phase shift between the biases.

FIG. 5B is a graph showing a cyclical change in the potential difference between the bias applied to the charge eliminating needle 35 and the bias applied to the secondary transfer roller 52 when the frequencies of these biases are the same, but there is a half-cycle phase shift between these biases, which is the maximum phase shift possible. As shown in FIG. 5B, the crest and the trough of one wave overlap with the crest and the trough of the other wave. Hence, the potential difference between these biases is 10 kV, which is the sum of half the peak voltages of both biases.

Figure 5C:
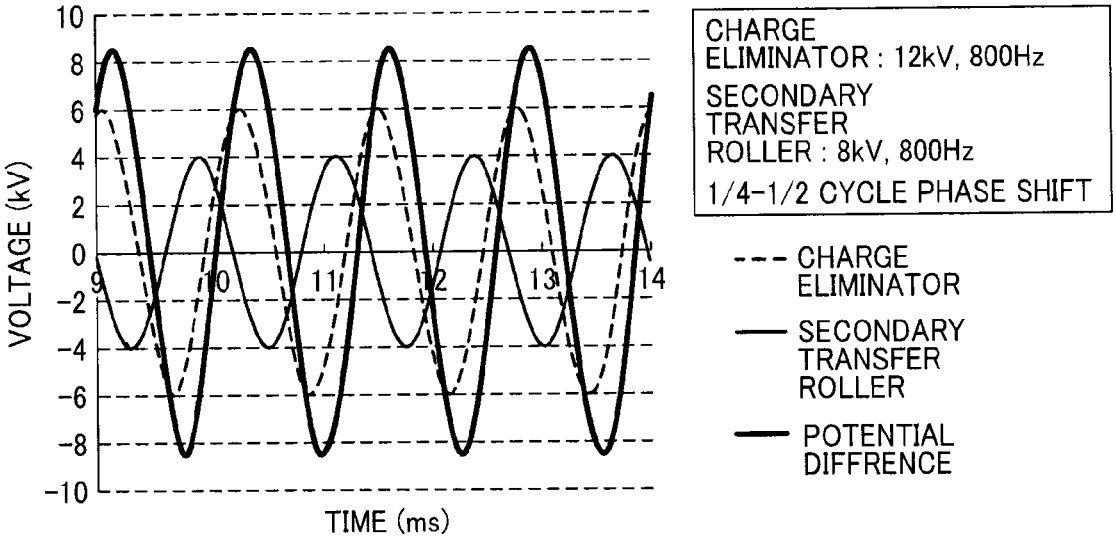
FIG. 5C is a graph showing a cyclical change in the potential difference between the bias applied to the charge eliminator and the bias applied the secondary transfer roller when the frequencies of the biases are the same but there is a phase shift of ±¼ cycle or greater between the biases.

FIG. 5C is a graph showing a cyclical change in the potential difference between the bias applied to the charge eliminating needle 35 and the bias applied the secondary transfer roller 52 when the frequencies of these biases are the same, but there is a phase shift of equal to or greater than a quarter cycle between these biases. As shown in FIG. 5C, the potential difference between the bias applied to the charge eliminating needle 35 and the bias applied to the secondary transfer roller 52 is not as much as the example shown in FIG. 5B with the half-cycle phase shift. However, the crest and the trough of one wave generally overlap with the crest and the trough of the other wave. Thus, the potential difference is still large.

Figure 5D:
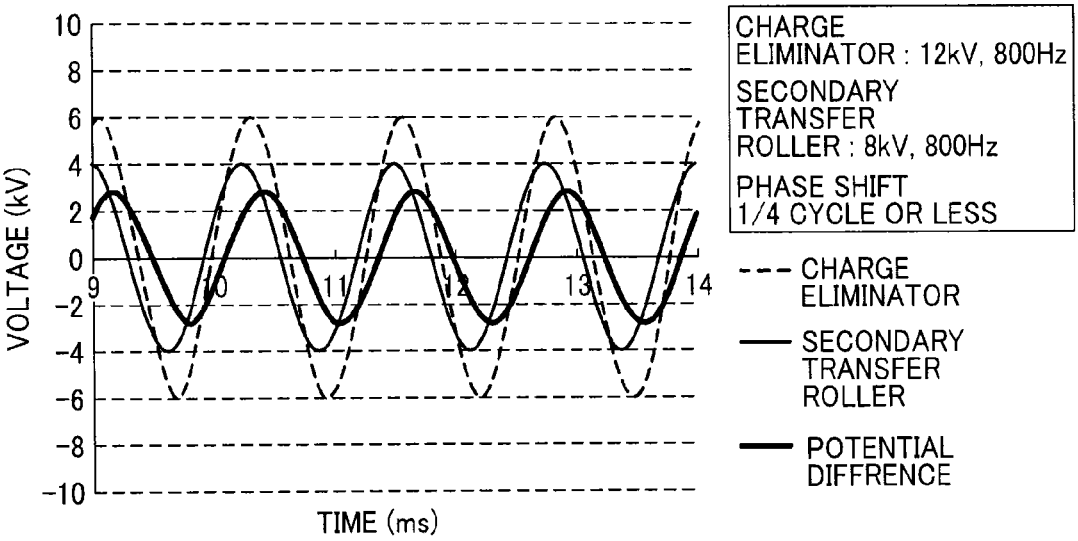
FIG. 5D is a graph showing a cyclical change in the potential difference between the bias applied to the charge eliminator and the bias applied the secondary transfer roller when the frequencies of the biases are the same but there is a phase shift of equal to or less than ±¼ cycle.

FIG. 5D is a graph showing a cyclical change in the potential difference between the bias applied to the charge eliminating needle 35 and the bias applied the secondary transfer roller 52 when the frequencies of these biases are the same, but there is a phase shift of equal to or less than a quarter cycle. As shown in FIG. 5D, the potential difference between the bias applied to the charge eliminating needle 35 and the bias applied to the secondary transfer roller 52 is relatively small, because the crest of one wave generally overlaps with the crest of the other wave, and the trough of one wave generally overlaps with the trough of the other wave.

Figure 5E:
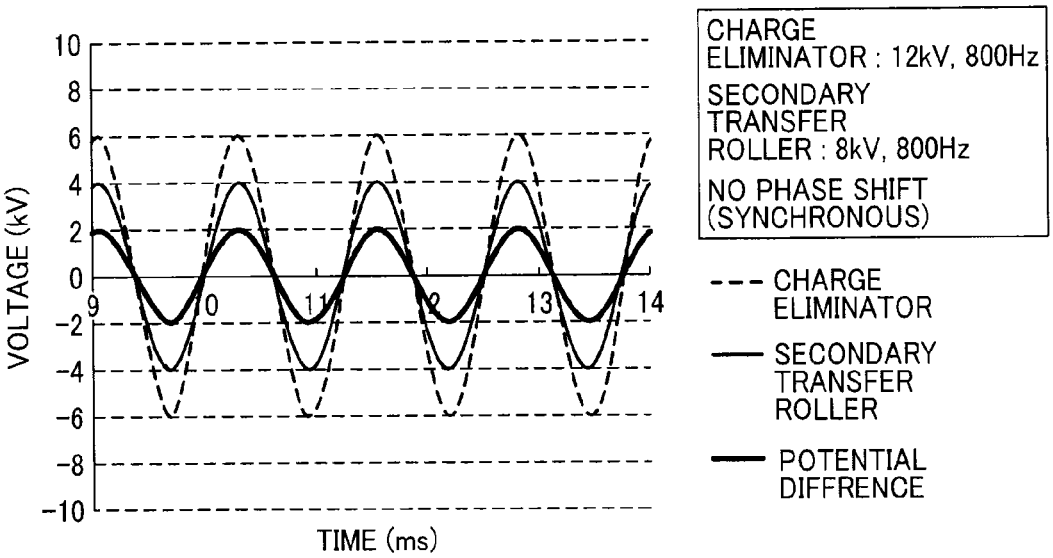
FIG. 5E is a graph showing a cyclical change in the potential difference between the bias applied to the charge eliminator and the bias applied the secondary transfer roller when the frequencies of the biases are the same and there is no phase shift.

FIG. 5E is a graph showing a cyclical change in the potential difference between the bias applied to the charge eliminator and the bias applied the secondary transfer roller when the frequencies of the biases are the same and there is no phase shift. As shown in FIG. 5E, the potential difference between the bias applied to the charge eliminating needle 35 and the bias applied to the secondary transfer roller 52 is small, because the crest of one wave overlaps with the crest of the other wave, and the trough of one wave overlaps with the trough of the other wave. The potential difference is 2 kV, which is half the difference between the peak voltages of these biases.

As can be understood from FIGS. 5A through 5E, in order to obtain a small potential difference between the bias applied to the charge eliminating needle 35 and the bias applied to the secondary transfer roller 52, the frequencies of both biases are the same while the phase shift is equal to or less than a quarter cycle. As the potential difference is small, an electric field that changes cyclically between the charge eliminating needle 35 and the secondary transfer roller 52 can be always small while preventing leakage between the charge eliminating needle 35 and the secondary transfer roller 52. It is to be noted that when the frequency and the phase of the bias applied to the charge eliminating needle 35 coincide with the frequency and the phase of the secondary transfer roller 52, the potential difference between these biases is the smallest.

Similar to the high voltage AC power supply 72, the voltage applicator 36 is disposed outside the loop formed by the intermediate transfer belt 50. More specifically, the voltage applicator 36 is spaced apart an adequate distance from the high voltage DC power supplies 60 and 70 via the secondary transfer roller 52 and the secondary transfer counter roller 51. With this configuration, the alternating current does not interfere with the high voltage wires and the signal lines of the direct current power supplies 60 and 70. That is, interference between the high power wires and noise on the signal lines are prevented.

Figure 6:
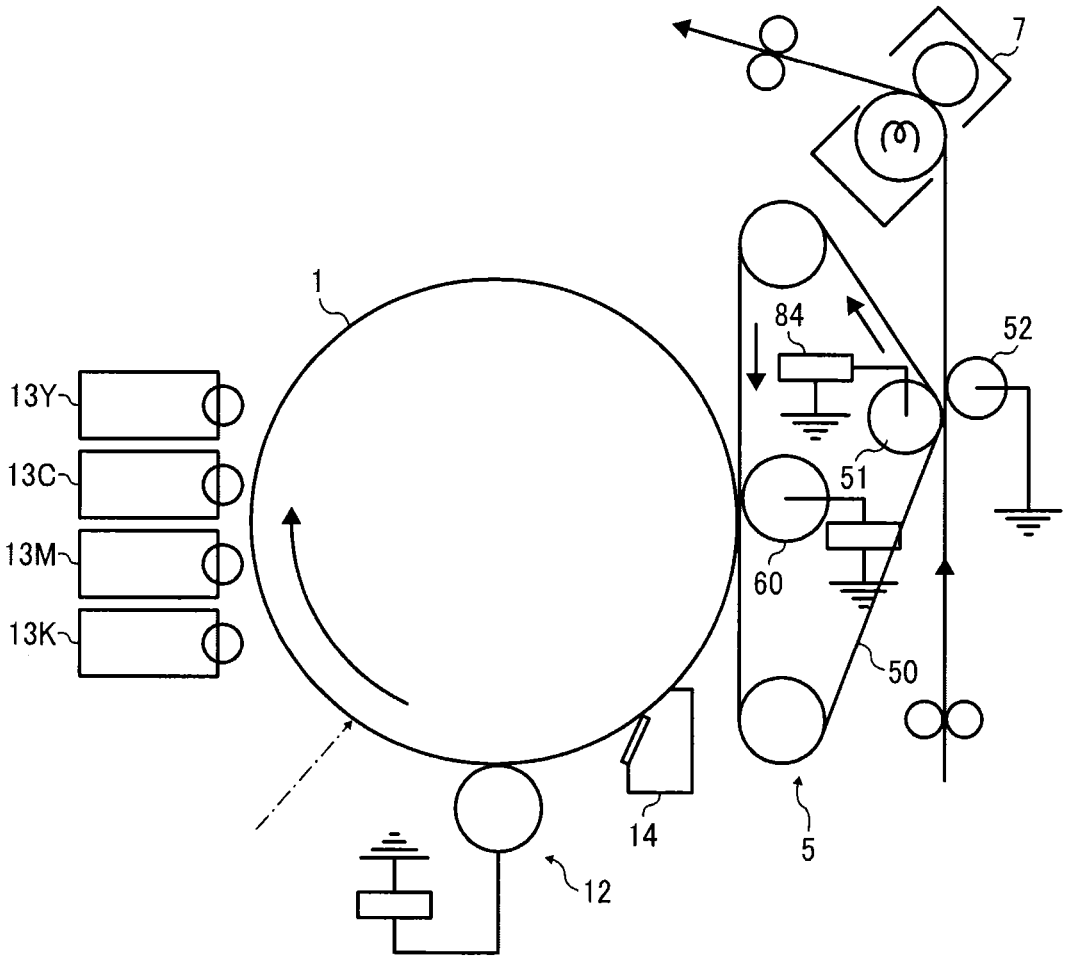
FIG. 6 is a schematic diagram illustrating another example of an image forming apparatus according to an illustrative embodiment of the present invention.

Furthermore, the present invention can be applied to an image forming apparatus such as that shown in FIG. 6. FIG. 6 is a schematic diagram illustrating another example of an image forming apparatus in which the present invention can be implemented. It is to be noted that the suffixes Y, M, C, and K indicating colors are omitted, unless otherwise specified. The same reference numerals are given to constituent elements corresponding to the constituent elements shown in FIG. 1, and redundant descriptions thereof will be omitted unless otherwise stated.

The image forming apparatus illustrated in FIG. 6 is a printer and includes one photosensitive drum 1 surrounded by the developing devices 13Y, 13M, 13C, and 13K. When forming an image, the surface of the photosensitive drum 1 is charged uniformly by the charging device 12. Subsequently, the surface of the photosensitive drum 1 is illuminated with a light beam modulated based on image data associated with the color yellow. An electrostatic latent image for the color yellow is formed on the surface of the photosensitive drum 1.

Subsequently, the electrostatic latent image is developed into a visible image, known as a toner image of yellow with yellow toner by the developing device 13Y, and the toner image is transferred primarily onto the intermediate transfer belt 50. After transfer, there may be some toner left on the surface of the photosensitive drum 1. Such residual toner is removed from the photosensitive drum 1 by the drum cleaner 14. After cleaning, the photosensitive drum 1 is charged uniformly again by the charging device 12 in preparation for the subsequent imaging cycle.

Next, the surface of the photosensitive drum 1 is illuminated with a light beam modulated based on image data for magenta to form an electrostatic latent image of magenta on the surface thereof. The developing device 13M develops the electrostatic latent image with toner of magenta, forming a toner image of magenta. The toner image of magenta is transferred on top of the toner image of yellow. Similar to the toner images of yellow and magenta, electrostatic latent images of cyan and black are formed and developed into toner images of cyan and black on the respective photosensitive drums 1. The toner images of cyan and black are transferred onto the intermediate transfer belt 50 so that they are superimposed one atop the other over the toner image of magenta on the toner image of yellow. Accordingly, a composite color toner image is formed on the intermediate transfer belt 50.

Subsequently, the composite toner image on the intermediate transfer belt 50 is transferred onto the recording medium in the secondary transfer nip and fixed by the fixing device 7. After fixing the composite toner image on the recording medium, the recording medium is discharged outside the image forming apparatus.

The image forming apparatus of the present illustrative embodiment may include the secondary transfer power supply 84 as in the first illustrative embodiment.

According to the foregoing embodiments, the belt-type intermediate transfer member is employed. However, the intermediate transfer member is not limited to a belt. Alternatively, a drum-type intermediate transfer member may be employed.

According to an aspect of this disclosure, the present invention is employed in the image forming apparatus. The image forming apparatus includes, but is not limited to, an electrophotographic image forming apparatus, a copier, a printer, a facsimile machine, and a multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

a photosensitive member to bear an electrostatic latent image on a surface thereof;

a developing device to develop the electrostatic latent image formed on the photosensitive member using toner to form a toner image;

an intermediate transfer member to bear the toner image on the surface thereof, the intermediate transfer member disposed opposite the photosensitive member and formed into a loop;

a primary transfer device to transfer the toner image from the photosensitive member onto the intermediate transfer member;

a secondary transfer device to transfer the toner image from the intermediate transfer member onto a recording medium, the secondary transfer device disposed outside the loop formed by the intermediate transfer member to contact the intermediate transfer member and form a secondary transfer nip therebetween;

a first power supply to apply a constant-current controlled direct current bias to an inner circumferential side of the intermediate transfer member, the direct current bias having the same polarity as that of the toner image; and a second power supply to form an alternating electric field between the intermediate transfer member and the recording medium, the first power supply and the second power supply applying predetermined biases simultaneously when the recording medium is in the secondary transfer nip to transfer the toner image thereon, wherein the first power supply is disposed inside the loop formed by the intermediate transfer member and the second power supply is disposed outside the loop formed by the intermediate transfer member.

2. The image forming apparatus according to claim 1, wherein the first power supply supplies a direct current superimposed on an alternating current, and the secondary transfer device is grounded.

3. The image forming apparatus according to claim 1, wherein the first power supply is a constant-current controlled direct current (DC) power supply and the second power supply is an alternating current (AC) power supply connected to the secondary transfer device.

4. The image forming apparatus according to claim 1, further comprising a third power supply connected to the primary transfer roller to supply a direct current to the primary transfer roller, wherein the third power supply is a direct current power supply disposed inside the loop formed by the intermediate transfer member.

5. The image forming apparatus according to claim 4, further comprising a board on which the first power supply and the third power supply are disposed, wherein the board is disposed inside the loop formed by the intermediate transfer member.

6. The image forming apparatus according to claim 3, further comprising:

a charge eliminator to eliminate electric charge from the recording medium, disposed downstream from the secondary transfer nip in the direction of transport of the recording medium; and a voltage applicator to supply one of an alternating current voltage and an alternating voltage consisting of a superimposed voltage of a direct current and an alternating current to the charge eliminator, wherein when the voltage applicator supplies one of the alternating current voltage and the alternating voltage consisting of the superimposed voltage to the charge eliminator, a frequency of the alternating current voltage supplied to the secondary transfer member coincides with a frequency of one of the alternating current voltage and the alternating current component of the alternating voltage supplied to the charge eliminator, and a phase shift is less than or equal to a quarter cycle.

7. The image forming apparatus according to claim 6, wherein the second power supply is connected to the secondary transfer member and the voltage applicator is disposed outside the loop formed by the intermediate transfer member.

8. The image forming apparatus according to claim 7, further comprising a third power supply connected to the primary transfer roller to supply a direct current to the primary transfer roller, wherein the third power supply is a direct current power supply disposed inside the loop formed by the intermediate transfer member.

9. An image forming apparatus, comprising:

an intermediate transfer belt that bears a toner image;

a secondary transfer roller that transfers the toner image from the intermediate transfer belt onto a sheet at a transfer nip;

a counter roller disposed inside the intermediate transfer belt at the transfer nip;

a DC power supply that applies a direct current bias to the counter roller; and an AC power supply that applies an alternating current bias to the secondary transfer roller, wherein the DC power supply is disposed inside the intermediate transfer belt and the AC power supply is disposed outside the intermediate transfer belt.

10. The image forming apparatus according to claim 9, further comprising:

a primary transfer roller that transfers the toner image from a photosensitive drum onto the intermediate transfer belt;

a primary transfer power supply that applies a primary transfer bias to the primary transfer roller; and a board disposed inside the intermediate transfer belt, wherein the primary transfer power supply and the DC power supply are disposed on the board.

11. The image forming apparatus according to claim 10, further comprising a housing that includes the intermediate transfer belt, the counter roller, the DC power supply, the primary transfer roller, the primary transfer power supply and the board, wherein the housing is detachably attachable relative to the image forming apparatus.

12. The image forming apparatus according to claim 9, further comprising a second housing that includes the secondary transfer roller and the AC power supply, wherein the second housing is detachably attachable relative to the image forming apparatus.

13. An image forming apparatus, comprising:

a photosensitive drum that bears a toner image;

an intermediate transfer belt that contacts the photosensitive drum;

a primary transfer roller that transfers the toner image from the photosensitive drum onto the intermediate transfer belt;

a secondary transfer roller that transfers the toner image from the intermediate transfer belt onto a sheet;

a charge eliminating needle disposed at the downstream side of a transfer nip in a direction of transport of the sheet;

a primary transfer power supply that applies a primary transfer bias to the primary transfer roller;

a harness that connects the primary transfer power supply to the primary transfer roller;

a secondary transfer AC power supply that applies an alternating current bias to the secondary transfer roller; and a charge eliminating AC power supply that applies an alternating current bias to the charge eliminating needle, wherein the harness is disposed inside the intermediate transfer belt.

14. The image forming apparatus according to claim 13, wherein a frequency of the alternating current bias applied to the secondary transfer AC power supply coincides with a frequency of the alternating current bias applied to the charge eliminating AC power supply.

15. The image forming apparatus according to claim 13, wherein the secondary transfer AC power supply and the charge eliminating AC power supply are disposed outside the intermediate transfer belt.

* * * * *